United States Patent [19]

Nakayama

[11] 4,243,329

[45] Jan. 6, 1981

[54] WATCH MOVEMENT CONSTRUCTION

[75] Inventor: Yasuaki Nakayama, Hanno, Japan

[73] Assignee: Citizen Watch Co., Ltd., Tokyo, Japan

[21] Appl. No.: 954,501

[22] Filed: Oct. 25, 1978

[30] Foreign Application Priority Data

| | | | |
|---|---|---|---|
| Nov. 1, 1977 | [JP] | Japan | 52-131140 |
| Nov. 24, 1977 | [JP] | Japan | 52-141031 |
| Dec. 6, 1977 | [JP] | Japan | 52-163592[U] |
| Dec. 13, 1977 | [JP] | Japan | 52-149777 |
| Dec. 13, 1977 | [JP] | Japan | 52-149778 |
| Dec. 13, 1977 | [JP] | Japan | 52-167283[U] |
| Dec. 14, 1977 | [JP] | Japan | 52-150009 |
| Dec. 14, 1977 | [JP] | Japan | 52-168202[U] |
| Dec. 21, 1977 | [JP] | Japan | 52-153714 |
| Dec. 21, 1977 | [JP] | Japan | 52-153717 |
| Dec. 23, 1977 | [JP] | Japan | 52-155131 |
| Dec. 27, 1977 | [JP] | Japan | 52-175179[U] |
| Mar. 29, 1978 | [JP] | Japan | 53-40547[U] |

[51] Int. Cl.[3] ..... G04B 19/00; G04B 29/04; G04C 23/04

[52] U.S. Cl. ..... 368/76; 368/85; 368/88

[58] Field of Search ..... 58/23 A, 7, 23 R, 23 D, 58/52 R, 88 R, 59, 85.5, 127 B; 361/397, 398; 368/62, 76–78, 85, 88, 144, 228

[56] References Cited

U.S. PATENT DOCUMENTS

| | | | |
|---|---|---|---|
| 3,676,993 | 7/1972 | Bergey et al. | 58/23 R |
| 3,748,845 | 7/1973 | Mutter et al. | 58/23 A |
| 3,778,999 | 12/1973 | Yuffray | 58/23 R |
| 3,902,312 | 9/1975 | Yamazaki | 58/23 D |

FOREIGN PATENT DOCUMENTS

| | | | |
|---|---|---|---|
| 370705 | 8/1963 | Switzerland | 58/127 B |

*Primary Examiner*—Edith S. Jackmon
*Attorney, Agent, or Firm*—Jordan and Hamburg

[57] ABSTRACT

A watch movement construction has a time dial and a base plate having its one surface fixedly supporting the time dial and including a central region and first and second marginal regions. A wheel train mechanism is disposed in the central region of said base plate substantially in the same plane as the base plate. An electro-mechanical transducer is disposed in the first marginal region of the base plate substantially in the same plane as the wheel train mechanism. An electronic circuit section includes a circuit substrate and a plurality of electronic components disposed in the second marginal region of the base plate substantially in the same plane as the wheel train mechanism and the electro-mechanical transducer.

74 Claims, 28 Drawing Figures

WATCH MOVEMENT CONSTRUCTION

This invention relates to a movement construction of an electronic wristwatch, and more particularly to the watch movement construction adapted to be accommodated in a thin, quartz wristwatch.

Even the thinnest prior art quartz wristwatches have a movement thickness approximately equal to 2.9 mm. Since thinner movements such as are found in mechanical wristwatches have not been available for quartz wristwatches, it has not been possible to manufacture thinner, lighter and more attractive quartz wristwatches comparable to a mechanical wristwatch having a movement with a thickness of less than 2.5 mm. The reason for this is that it has been difficult to reduce the size and thickness of such component parts as the coil and rotor that constitute a quartz wristwatch, and because the arrangement of these parts within the movement has been quite complicated, it becomes difficult to reduce overall size and thickness of the wristwatch.

The present invention overcomes the difficulties encountered in the prior art and provides an extremely thin movement having a thickness of less than 2 mm, thereby making it possible to obtain a quartz wristwatch having an extremely thin design.

Figure 1:
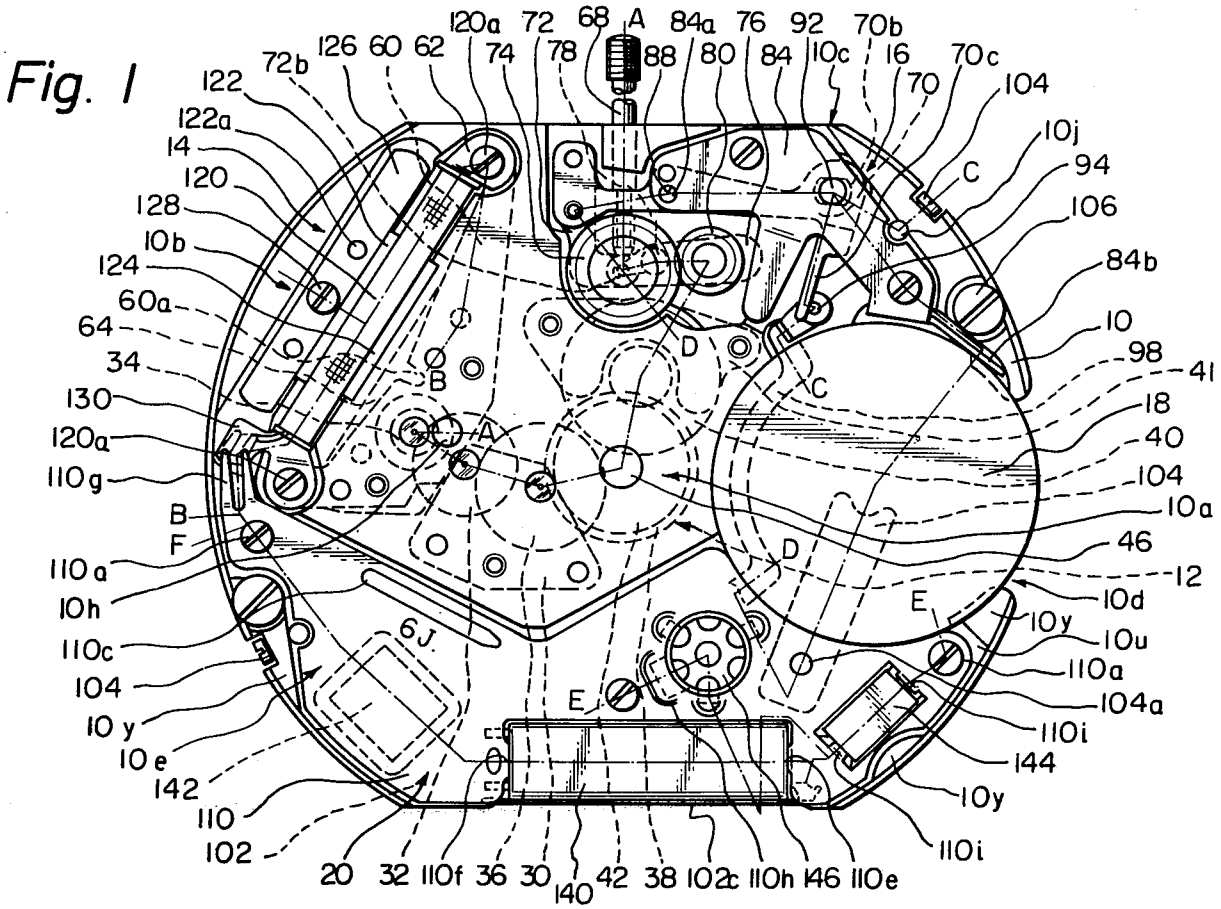
FIG. 1 is a plan view of a movement construction for an electronic wristwatch according to the present invention.

Referring now to FIG. 1, there is shown a preferred embodiment of an electronic wristwatch movement construction according to the present invention. The movement construction comprises a base plate 10 having a central region 10*a* for supporting a wheel train mechanism 12 at a central part of the base plate 10 such that the wheel train mechanism 12 is substantially aligned in the same plane as the base plate 10, a first marginal region 10*b* for supporting an electro-mechanical transducer 14 such that the electro-mechanical transducer 14 is substantially aligned in the same plane as the wheel train mechanism 12, a second marginal region 10*c* for supporting a hand setting mechanism 16 such that the hand setting mechanism 16 is substantially aligned in the same plane as the wheel train mechanism 12, a third marginal region 10*d* for supporting a battery 18, and a fourth marginal region 10*d* for supporting a battery 18, and a fourth marginal region 10*e* for supporting electronic circuit section 20 and its associated components such that the electronic circuit section 20 and its associated components are substantially aligned in the same plane as the wheel train mechanism 12. The first, second, third and fourth regions are provided around the central region 10*a*.

Figure 2:
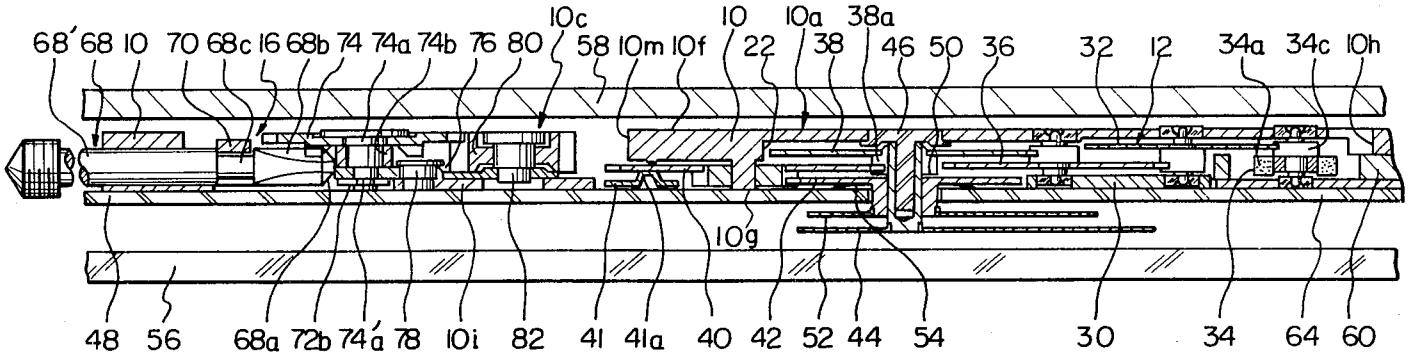
FIGS. 2 to 7 are cross-sectional views taken along the lines A—A, B—B, C—C, D—D, E—E and F—F of FIG. 1.
Figure 3:
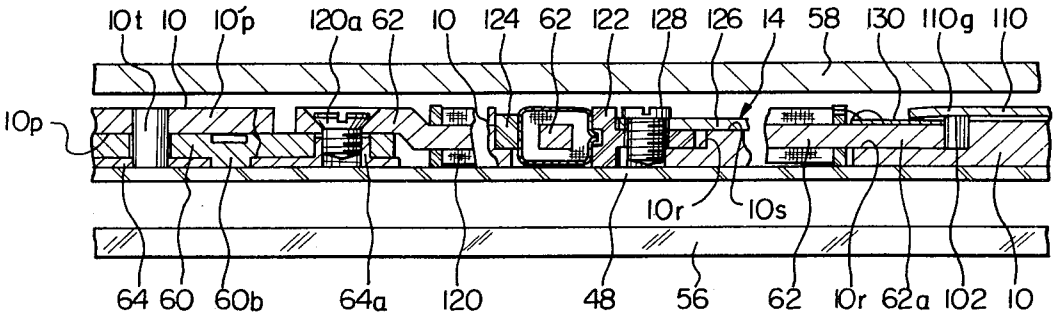
Figure 4:
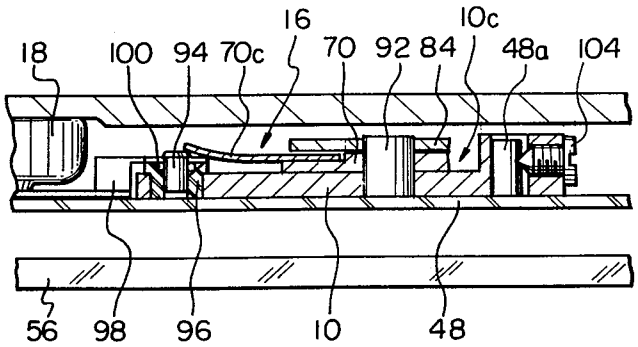
Figure 5:
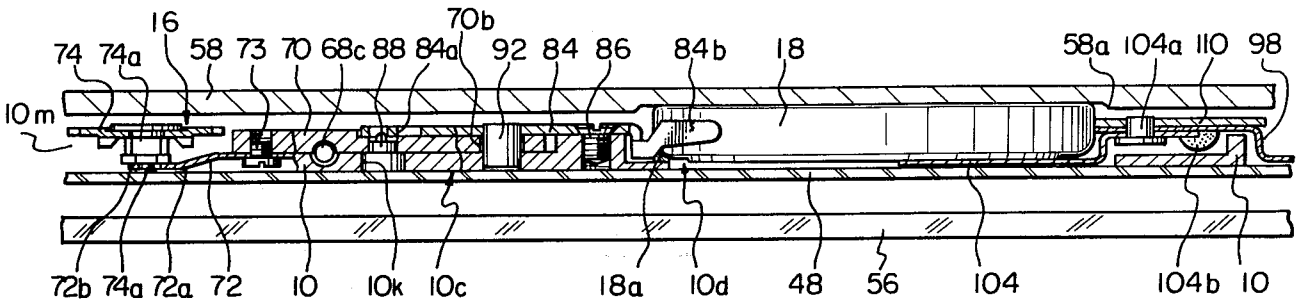

FIG. 2 is a cross section on line A—A of FIG. 1 and shows the relationship between the central portion 10*a* of the base plate 10 and the wheel train mechanism 12 and the relationship between the second marginal portion 10*c* and a part of the hand setting mechanism 16. FIG. 3 is a cross section on line B—B of FIG. 1 and shows the relationship between the first marginal portion 10*b* of the base plate 10 and the electromechanical transducer 14. FIG. 4 is a cross section on line C—C of FIG. 1 and shows the relationship between another part of the second marginal region 10*c* and another part of the hand setting mechanism 16. FIG. 5 is a cross section on line D—D of FIG. 1 and shows the relationship between the third marginal region 10*d* and the battery 18 and the relationship between the second marginal region 10*c* and another part of the hand setting mechanism 16.

Figure 6:
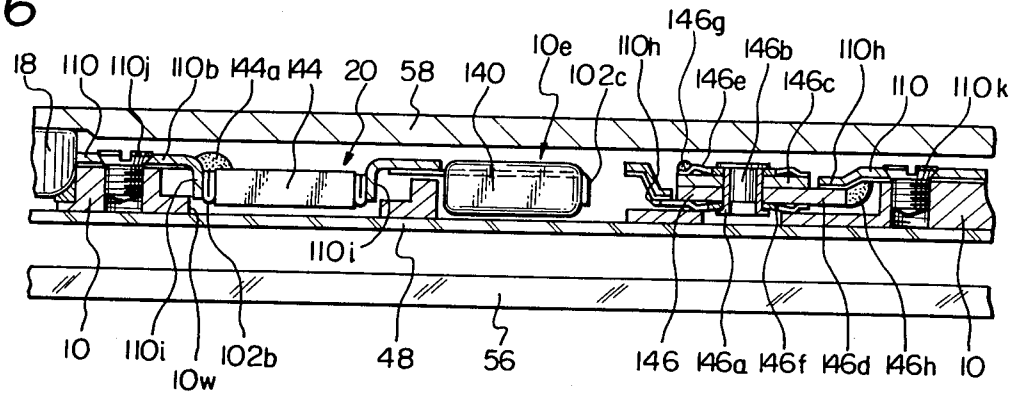
Figure 7:
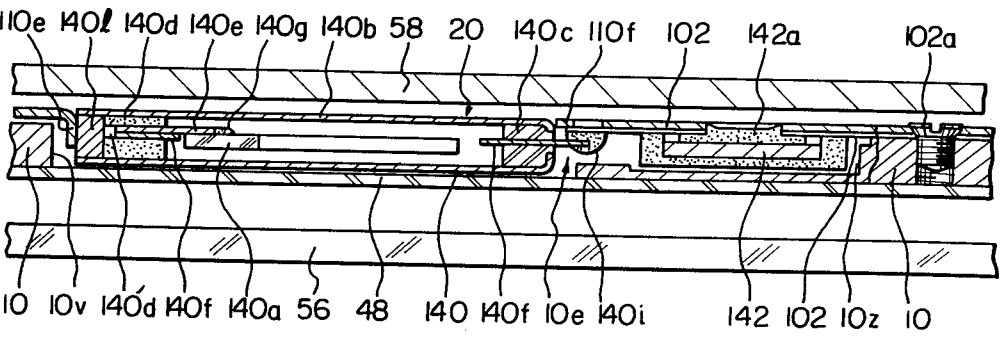

FIG. 6 is a cross section on line E—E of FIG. 1 and shows the relationship between the fourth marginal region 10*e* of the base plate 10 and the electronic circuit section 20. FIG. 7 is a cross section on line F—F of FIG. 1 and shows the relationship between the fourth marginal region 10*e* of the base plate 10 and another part of the electronic circuit section 20.

Turning now to FIG. 2, the base plate 10 is formed at its central region 10*a* with a recessed portion 22 on a first or lower side 10*g* of the base plate 10, to accommodate the wheel train mechanism 12 in the recessed portion 22 inwardly of the lower side 10*g*. The wheel train mechanism 12 is supported by a bottom wall 28 of the recessed portion 22, and a wheel train bridge 30 disposed in the recessed portion 22 and secured to the lower side 10*g* of the base plate 10. The wheel train mechanism 12 is shown as comprising a fourth wheel and pinion 32 meshing with a rotor pinion 34*c* of a rotor 34 having a rotor magnet 34*a*, a third wheel and pinion 36 meshing with a pinion of the fourth wheel and pinion 32, a center wheel 38 meshing with a pinion of the third wheel and pinion 36, a minutes wheel 40 meshing with the center wheel 38, and an hours wheel 42 meshing with the minutes wheel 40. The center wheel 38 has a cannon pinion 38*a* connected to a minutes hand 44 and rotatably mounted on a central shaft 46. The central shaft 46 has its upper end substantially aligned with an upper side 10*f* of the base plate 10 and fixedly supported by the bottom wall 28 of the recessed portion 22. The central shaft 46 extends toward a time dial or dial plate 48. Indicated as 50 is a seat which separates the center wheel 38 from the hours wheel 42 connected to an hours hand 52. Denoted at 54 is a dial washer adapted to urge the hours wheel 42 and cannon pinion 38*a* towards the bottom wall 28 of the recessed portion 22 so that the resultant moderate sliding torque restrains hours and minutes hands 52 and 44 from tilting both horizontally and vertically. Reference numeral 56 denotes a watch glass disposed below the lower side of the base plate 10, and 58 a back cover disposed on upper side of the base plate 10.

While the vertical or axial oscillation of the hours and minutes hands is largely dependent upon the length over which the cannon pinion 38*a* is movably mounted on the central shaft 46, the stable movement of the hands can be obtained it, as shown in FIG. 2, the central shaft 46 is studded on the thin wall portion 28 of the recessed portion 22 to obtain a sufficient length of the shaft portion. Meanwhile, the vertical spacing between the base plate 10 and the dial plate 48 is the largest at region of the thin wall portion 28 so that sufficient clearance is ensured for accommodating the wheel trains without vital influence on the thickness of the movement construction.

With the arrangement mentioned above, the minutes wheel 40 meshing with the cannon pinion 38*a* of the center wheel 38 is aligned in substantially the same plane with the reduction wheel composed of the third wheel and pinion 36 delivering a drive power from the rotor to the center wheel 38, contributing the reduction of the thickness of the movement construction. The minutes wheel 40 is held in a place by three projections 41*a* of a minutes wheel support member 41 and selectively coupled to the setting mechanism 16 for time correction.

The rotor 34 is rotated by stator 60 subject to the alternating magnetic flux delivered from a core 62, and the fourth wheel and pinion 32, third wheel and pinion 36 and center wheel and pinion 38 with cannon-pinion 38*a* reduce the rotation speed of the rotor 34. The rotor 34 and reduction wheel and pinions 32 and 36 are rotatably supported at their upper ends by bearings formed of polyacetal resin and pressfitted in the base plate 10. Preferably, they may be supplied with an appreciable volume of lubricant. At lower ends, the reduction wheel and pinions 32 and 36 are rotatably supported by similar bearings embedded in wheel train bridge 30 secured to the underside of the base plate 10 by screws. For the observation of the operation, the base plate 10 is formed with an access opening 10*h* at a position near the rotor 34. The reduction wheel train mechanism is hardly visible from the back cover side.

A lower end of the rotor 34 is rotatably supported by a bearing made of polyacetal resin mounted on a stator retaining plate 64 secured to the stator 60. The height of the rotor 34 is selected to have a value substantially equal to the thickness of the base plate 10 as shown in FIG. 2. To enhance the efficiency of the electromechanical transducer 14, the volume of the rotor magnet 34*c* must be increased. This is achievable by: presetting the vertical or axial clearance between the fourth wheel and pinion 32 and the stator 60, whose thickness is equal to or somewhat larger than that of the rotor magnet 34*a* to a small value less than five times the thickness of the fourth wheel and pinion 32, tightly engaging the rotor supporting bridge 64 with the stator 60 and equalizing the total of the thicknesses of the base plate 10 adjacent to the rotor 34, rotor supporting bridge 64, stator 60, fourth wheel and pinion 32 and the small clearance between the fourth wheel and pinion 32 and the stator 60 with the basic thickness of the movement construction except small portions projecting beyond the movement. In a quartz crystal wrist watch, the reduction wheel trains should preferably be 0.1–0.05 mm thick in consideration of the surface pressure strength of the teeth, warp during machining and the connecting force with the pinion. Meanwhile, the vertical clearance between the reduction wheel and any other neighboring part must be several times the thickness of the reduction wheel.

The wheel train mechanism 12 thus arranged is associated with the hand setting mechanism 16 provided at the second marginal region 10*c* of the base plate 10. In FIGS. 1 and 2, the base plate 10 is provided at its second marginal region 10*c* with a radially extending bore 66 through which time setting stem 68 radially extends toward the central region 10*a* in which the wheel train mechanism 12 is provided. The time setting stem 68 has a shaft portion 68' and is chamfered at its innermost end 68*a* to push a setting lever of the setting mechanism 16 up during the assembly. The time setting stem 68 also has a large diameter portion 68'*b* integral with toothed portion 68*b* and a stepped or reduced diameter portion 68*c*. The large diameter portion 68'*b* is identical in diameter to the toothed portion 68*b*. The setting lever 70 extends perpendicular to the axis of the time setting stem 68 and engages with the stepped portion 68*c* of the time setting stem 68. A clutch lever 72 is secured to the setting lever 70 by screw 74 (see FIG. 5) and has a downwardly bent portion 72*a* provided with a bifurcated end 72*b*. The bifurcated end 72*b* of the clutch lever 72 engages with an end 74'*a* of a setting wheel shaft 74*a*. The setting wheel shaft 74*a* supports a setting wheel 74 on a change-over lever 76 in spaced relationship with respect thereto by means of a spacer or washer 74*b*. Thus, the clutch lever 72 is operable to actuate the change-over lever 76 by means of the bifurcated end 72*b* engaging with the end 74'*a* of the setting wheel shaft 74*a*. The changeover lever 76 is pivotable about a pivot shaft 78 fixed to a thinned wall portion 10*i* of the base plate 10. The change-over lever 76 rotatably supports an intermediate wheel 80 on the same side as the setting wheel 74 by means of an intermediate wheel shaft 82 fixed to the change-over lever 76. The intermediate wheel 80 is held in engagement with the setting wheel 74.

The setting lever 70 and a part of the change-over lever 76 are retained between the base plate 10 and a setting lever spring 84 secured to an upper side of the base plate 10 by two screws 86. The setting lever spring 84 has a pair of adjacent holes 84*a* for positioning a pin 88 on the setting lever 70 with its vertical resilient force, and a battery retaining arm 84*b* bent downward and retaining the battery 18 while ensuring an electrical conduction with the battery 18. Indicated as 90 in FIG. 5 is a resilient conductive member providing a reliable electrical conductance between the battery 18 and the battery retaining arm 84*b* of the setting lever spring 84. The setting lever spring 84 is spaced from back cover 58 by a predetermined distance to allow a prescribed amount of lift of the setting lever spring 84. Since the pin 88 of the setting lever 70 has a rounded end adapted to engage with an edge of the hole 84*a*, the setting lever spring 84 provides a snap action effect on the movement of the time setting stem 68. Since the setting lever spring 84 has a moderate thickness, an end portion of the setting lever spring 84 is used as the battery retaining arm 84*b* to reduce separate components. Denoted at 18*a* in FIG. 5 is a shock absorptive portion formed of conductive rubber and disposed in a crimped portion of the lid of the battery 18. Since the space which the rubber member 18*a* occupies has a generally triangular section, the rubber member 18*a* exerts an intense cushioning force against excessive compression and, thus, permits little displacement of the battery 18 towards the dial plate 48 even when the wrist watch is dropped. The setting lever spring 84 thus arranged is advantageous from the view point of cost and space requirements. The setting lever 70 has portion formed with an elongated slot 70*b* extending perpendicular to the axis of the time setting stem 68. The elongated slot 70*b* of the setting lever 70 accommodates therein a stud 92 secured to the base plate 10 and axially extending, i.e., in a direction perpendicular to the plane of the setting lever 70. The elongated slot 70*b* of the setting lever 70 provides a play in the longitudinal direction of the setting lever 70, i.e., in a direction perpendicular to the axis of the time setting stem 68, since the clearance between the time setting stem 68 and the setting lever 70 engaging with the time setting stem 68 is very small. The time setting stem 68 and the setting lever 70 therefore engage with each other in a highly reliable fashion to cause the setting mechanism to operate in a reliable manner.

As seen in FIGS. 1 and 4, a positive contact spring 70*c* is connected at its one end to the setting lever 70 by some suitable means such as welding. The positive contact spring 70*c* has its another end urged toward and engages with a contact member 94 fixedly supported by an insulating bush 96 secured to the base plate 10. The contact member 94 is electrically connected to a lead terminal member 98 by a soldering 100, with the lead terminal member 98 being held in electrical contact with an electrically conductive sheet 102 disposed between the positive terminal of the battery 18 and the dial plate 48. Denoted at 10*j* in FIG. 1 is an opening for receiving a leg of the dial plate, 104 a screw for pressing the dial leg to a fixed position of the base plate 10 and 106 a case screw for rigidly mounting a movement to a casing (not shown) of the watch. Another set of opening 10*j* and screws 104 and 106 are provided on the base plate 10 in symmetric relation to those mentioned above. In the above arrangement, the hand setting mechanism 16 including time setting stem 68, setting lever 70, clutch lever 72, changeover lever 76, setting lever spring 84, setting wheel 74 and intermediate wheel 80 and the switch mechanism including positive contact spring 70*c* and contact member 94 are all located adjacent to each other and to the back cover 58 while being exposed to an area between the base plate 10 and back cover 58 to facilitate ready observation of the mutual relationship of the above components. Hence, all these mechanisms can easily be adjusted and repaired. In FIG. 5, a battery retaining spring or negative terminal spring 104 which is in contact with a negative terminal of the battery 18 resiliently pressed the battery 18 against the wall of a battery receiving recess 58*a* formed in the back cover 58. The spring 104 has its underside coated with an insulating material and is secured to circuit substrate 110 by a rivet 104*a*. The spring 104 is connected to the substrate 110 by soldering as at 104*b*. Indicated by 10*k* is an opening in which a jig will be inserted to push up and disengage the lever 70 from the time setting stem 68 when necessity arises.

The relationship between the hand setting mechanism 16 and the base plate 10 will be described in more detail with reference to FIGS. 2 and 5. The base plate 10 has a recessed portion 10*m* formed on upper side of the base plate 10 at its second marginal region 10*c*. The total thickness of the setting mechanism 16 composed of the time setting stem 68, setting lever 70, clutch lever 72, changeover lever 76, and the setting lever spring 84 is substantially equal to that of the base plate 10. This is achieved by incorporating the hand setting mechanism 16 into the recessed portion 10*m* formed at the second marginal region 10*c* of the base plate 10.

As previously noted, the electro-mechanical transducer 14 is disposed at the first marginal region 10*b* of the base plate 10 as shown in FIG. 1. In FIGS. 1 and 3, the electro-mechanical transducer 14 comprises, in addition to the rotor 34 and stator 60 having an air gap 60*a* in which the rotor is operatively disposed, a drive coil 120. The drive coil 120 has core 120*a* including its both ends bent and tightly secured to opposite ends of the stator 60 by screws 120*a*. The screws 120*a* are screwed into a boss portion 122*a* of stator retaining plate 122 secured to the lower side of the base plate 10, with the stator 60 being sandwiched between the stator retaining plate 64 and indented portion 10*p* of the base plate 10. The stator 60 has a downward projection 60*b* in engagement with a bore 64*b* of the stator retaining plate 64. Indicated at 60*a* is a notch formed in the stator 60 to provide a static equilibrium point for the rotor 34.

As best shown in FIG. 3, the base plate 10 has a cutout 10*q* and a recessed portion 10*r* formed on the upper side of the base plate 10 at its first marginal region 10*b*. The drive coil 120 whose thickness is substantially identical to that of the base plate 10 is disposed in the cutout 10*q* of the base plate 10 such that upper and lower surfaces of the drive coil 120 are substantially aligned with the upper and lower surfaces of the base plate 10. The drive coil 120 has its central portion rigidly supported by first coil retaining member 122 made of polyacetal resin and second coil retaining member 124 made of a silicone rubber. The first coil retaining member 122 has a portion placed on the wall of the recessed portion 10*r* of the base plate 10 and engages with one transverse side of the drive coil 120. Likewise, the second coil retaining member 124 is placed on the wall of the recessed portion 10*r* of the base plate and engages with another transverse side of the drive coil 122. The coil supporting structure thus arranged will satisfactorily prevent the drive coil 122 from being damaged by the impact shocks. The base plate 10 also has a second recessed portion 10*s* on which a magnetic shielding plate 126 is placed and secured to the second recessed portion 10*s* by a screw 128 screwed to the base plate 10, with the first coil retaining member 122 being interposed between the shielding plate 126 and the recessed portion 10*r* and secured thereto by the screw 128. The first coil retaining member 122 has pins 122*a* projecting upward and engaging bores of the shielding plate 126 to retain the plate 126 in a fixed place. Indicated at 10*t* is a stud downwardly extending from the upper side of the base plate 10 and having its lower end engaging with the upper surface of the dial plate 48. A total thickness of wall portion 10'*p* of the recessed portion 10*p* of the base plate, stator 60 and stator retaining plate 64 is substantially equal to the thickness of the base plate 10. The stator retaining plate 18 has a shape substantially similar to that of the stator 60 and is made of suitable material such as brass. Indicated at 120*a* is a lead wire of the drive coil 120 electrically connected to a terminal plate 130 formed on a transverse projection 62*a* of the core 62. The terminal plate 130 is pressed downward by a spring portion 110*g* of the substrate 110 through conductive flexible sheet 102.

Shown in lower and right parts of FIG. 1 are an electronic circuit section 20 and a battery section, respectively. Electronic circuit components are mounted on circuit substrate 110 which is formed of German silver and carries on its underside flexible conductive sheet 102 having a predetermined electrical pattern. The base plate 10 has its upper side formed with indented portion 10*u* at the fourth marginal region 10*e*. The circuit substrate 110 is placed on the indented portion 10*u* and secured thereto by screws 110*a* such that the upper surface of the circuit substrate 110 is substantially aligned with the upper surface of the base plate 10. Denoted at 140 is a quartz crystal oscillator, 142 an IC chip, 144 a capacitor for temperature compensation and 146 a trimmer capacitor. The quartz oscillator 140 is disposed in cutout 10*v* formed in the base plate 10 at its fourth marginal region 10*e* and resiliently supported by an axially extending bent portion 110*e* of the circuit substrate 110 and a bridge portion 110*f* of the substrate 110 such that the upper surface of the quartz crystal oscillator 140 is aligned with the upper surface of the base plate 10. Likewise, the capacitor 144 is disposed in cutout 10*w* of the base plate 10 and supported resiliently by bents 110*i* of the substrate 110. The trimmer capacitor 146 is disposed in recessed portion 10*x* of the base plate 10 and supported by stepped portions 110*h* of the circuit substrate 110, where corresponding parts of the conductive sheet 102 is also bent, such that the capacitor 146 is manually adjustable from the upper side by removing the back cover 58. The circuit substrate 110 includes spring portion 110*g* adapted to resiliently urge the terminal plate 130. The conductive sheet 102 is connected to positive lead portion 98 extending to the contact 94 and has a cable 102*c* extending along a side of the oscillator 140, with the cable 102*c* including conductive pattern which cannot be provided on the conductive sheet 102. Designated at 110*c* is a mark engraved on the circuit substrate 110. By taking advantage of the characteristics of German silver, the surface of the circuit substrate 110 may be mirror-finished or formed with a fair stripe pattern; the same surface finish may be provided to a portion of the base plate 10 which expands flat and wide as described hereinbefore. The use of a metal for the circuit substrate 110 is quite effective in such aspects as: counter boring for the screws 110*a* and others, engraving of the aforesaid mark, surface finishing, strength as a substrate, spring function provided by bents and flats, stepped portions formed by crimping and bending freely in compliance with desired levels of parts and connecting strength of parts. Thus, the circuit substrate 110 may be designed to bifunction as an electrostatic shield and a member for reinforcing relatively thin portions of the base plate 10 while serving for example as the bridge member 30 and minute wheel bridge 41 as well. The base plate 10 has thick portions 10*y* provided at the forth marginal region 10*e* of the base plate 10 near the idented portion 10*u*, with the thick portions 10*y* being engageable with the inner periphery of the casing (not shown) to position the movement with respect to the casing.

FIG. 6 is a section taken along line E—E of FIG. 1. The circuit substrate 110 has a contour conforming to that of the battery 18 and, in the vicinity of the battery 18, it is secured to the base plate 10 by a screw 110*j* driven into a spot facing 110*b* to assist in the positioning of the battery 18. The capacitor 144 for temperature compensation is connected with opposite turns 102*b* of the conductive sheet 102 which are supported by the bents 110*i* of the circuit substrate 110. An adhesive 144*a* of epoxy resin is employed to aid in the retention of the capacitor 144. The temperature characteristic of the capacitor 144 using barium titanate varies when heated by soldering. The illustrated structure is free from such a problem, however. In a conventional practice, long leads are first soldered to a capacitor body and aged whereupon the leads are soldered to a circuit substrate while giving due care to heat possibily applied to the capaicitor body. Thus, the illustrated structure is far more advantageous over the conventional one as regards time and labor as well as space requirement. The cable part 102*c* of the conductive sheet 102 extends along an outer side of the quartz crystal oscillator 140 and is bent at the end of the latter. The conductive pattern on the cable 102*c* is coated with an insulating material. The trimmer capacitor 146 is secured by soldering 146*h* to the stepped or crimped portion 110*h* of the substrate 110 which is fastened to the base plate 10 by screw 110*k*. A trimmer base 146*d* and a trimmer rotor 146*c* formed of a dielectric material are connected together by upper and lower springs 146*e* and 146*f*, a hollow pin 146*a* and a rivet 146*b* such that a moderate magnitude of sliding torque is developed. The upper spring 146*e* is rigidly mounted on the trimmer rotor 146*c* by soldering 146*g* is rigidly mounted on the trimmer rotor 146*c* by soldering 146*g* and, when manipulated for adjustment, it will turn the trimmer rotor 146*c* integrally. The lower spring 146*f* is abutted against wall portion 10'*x* of recessed portion 10*x* of the base plate 10 to bear a force which will be exerted downwards during above-mentioned adjustment. The stepped portion 110*h* of the circuit substrate 110 may be located in any position matching with a standard trimmer capacitor usable commonly in various timepieces.

FIG. 7 is a section taken on line F—F of FIG. 1. The quartz crystal oscillator 140 is shown as being supported resiliently by the bent 110*e* and bridge 110*f* of the circuit substrate 110 with an error in the length absorbed thereby. The oscillator 140 comprises a cylindrical casing 140*b* having Kovar glass 140*c*, a lead plate 140*f* carried by one end of the casing **140*b* sealingly through glass 140*c*, a spring 140*e* soldered to a quartz crystal vibrator 140*a* as at 140*g* and a ceramic block 140*d* having a bore 140'*d* in which the lead 140*f* and spring 140*e* are received in pressing engagement. The other end of the casing 140*b* is sealingly closed by a metal plug 140*h* so that the casing keeps vacuum therein. The plug 140*h* may be formed with a recess to ensure firm connection thereof with the bent 110*e* of the substrate 110. The lead plate 140*f* of the oscillator 140 is connected to the conductive sheet 102 by soldering 140*i*. Shown in a right section of FIG. 7 is the IC chip 142 disposed in recessed portion 10*z* of the base plate 10 and mounted to the lower surface of the conductive sheet 102 by a flip-chip system and covered with a coating 142*a*** of epoxy resin.

Figure 8:
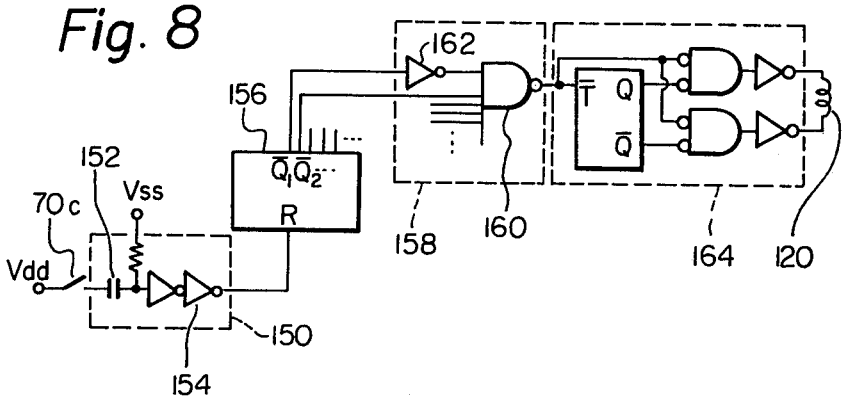
FIG. 8 is a block diagram of an example of an electronic circuit to be incorporated in a watch movement construction according to the present invention.

FIG. 8 is an example of a wiring diagram of an electronic circuit section 20 mentioned above. A switch circuit 150 including a differentiation circuit 152 and a waveform shaping circuit 154 is operated by switch spring **70*c* impressed with a voltage Vdd. An output of the switch circuit 150 is applied to a reset terminal R of an oscillator/divider 156 composed of suitable stages of flip-flops. Outputs $\overline{Q}_1$, $\overline{Q}_2$ . . . of the flip-flops are fed commonly to a waveform shaping circuit 158. The waveform shaping circuit 158 comprises a NAND gate 160 which receives through an inverter 162 only one $\overline{Q}_1$ of flip-flop outputs having the highest frequency. The highest frequency input of the waveform shaping circuit 158 is passed to a driver 164 arranged to provide the drive coil 120 with alternating drive pulses. The circuit shown in FIG. 8 is connected with the battery 18 through the switch 70*c*. When the winding crown is returned to its original position after hand setting operation has been performed, the switch 70*c* will close the circuit to establish power supply to each circuit element. In this case, the divider 156 is reset instantaneously, and the current allowed to flow through the drive coil 120 is too small to drive the rotor 34. The divider 156 is set upon lapse of a time period of the order of the time constant of the differentiation circuit 152 included in the switch circuit 150, e.g. 10 ms, and which is longer than a time period necessary for the hand setting wheel train to be disengaged from the reduction wheel train. When the divider 156 is set, the waveshaping circuit 158 immediately provides an output signal though delayed by a time interval equal to the duration of the pulse $\overline{Q}_1$ whereby a drive pulse current is caused to flow through the coil 120. During hand setting operation, the rotor 34 is inevitably turned and so the rotor cannot assume its predetermined static equilibrium condition. Since, however, a drive pulse current will flow through the coil 120 immediately after the winding crown has been returned to its original position, the rotor 34 is advanced by one setp if the orientation of the magnetic poles of the rotor 34 is aligned with the polarity of the output pulse applied to the coil 120 before the crown is manipulated, and, if otherwise, the rotor 34 remains stationary. Thereafter, the rotor 34 is rotated by pulses of exact intervals so that indication on the timepiece is restrained from being delayed though advanced. It will thus be appreciated that, under unused conditions, unnecessary consumption of the power of the battery 18 can be avoided by establishing the hand setting situation and that no adverse effects result from the manipulation for hand setting. It will also be understood that the timepiece achieves excellent reliability of operation because it dispenses with a slip mechanism and a brake mechanism conventionally interposed between the rotor 34 and the time setting stem 68**. The oscillator and divider may be designed to continue the operation only if the power capacity is sufficient.

Meanwhile, since the rotor 34 and reduction wheel train 12 are disposed in the recessed portion 22 of the base plate 10 and recessed portion 22 is almost hermetically closed by dial plate 48, the rotor 34 and reduction wheel train are protected against fine particles of dust introduced through a portion surrounding the crown and a connecting portion of the back cover 58. Hence, the timepiece needs no maintenance over a long time of use. Electronic parts of the timepiece which are hardly affected by dust are located adjacent to the back cover 58 to facilitate ready manipulation such as adjustment of running rate. Since each of blocks of electronic parts is positioned in the same plane as the reduction wheel train, part of the base plate 10 in which the reduction wheel train is disposed is prevented from being perforated when shaved despite such thinness of the timepiece. This restrains entry of particles of dust. The timepiece can be furnished with functional beauty. Because the movement structure has substantially the same thickness as the thickness of the base plate 10, parts can be mounted at precise levels on opposite surfaces of the base plate 10. Minute and hour wheels are movably mounted on the central shaft 46 of the base plate 10 so that oscillation of the hands is only negligibly permitting the overall thickness of the timepiece to be decreased. To further reduce the oscillation of the minute and hour wheels, the central shaft 46 may extend from the uppermost end of the base plate 10 as illustrated in FIG. 2. The wheel train bridge 30 is so shaped as to promote ready observation of the reduction wheel train though the observation is possible only when the dial plate 48 is removed. Furthermore, the invention is also applicable to timepieces using a transparent dial plate because movable parts of the movement neighbor the dial plate 48.

It will now be appreciated from the foregoing that a timepiece incorporating the movement construction of the present invention does not need be disassembled for cleaning over a long period of time and is thin enough to fit the wrist favorably.

Although the battery 18 has been shown as being a cylindrical cell type, the battery 18 may be of a thin sheet battery type and may be disposed on either side of the base plate 10.

Figure 9:
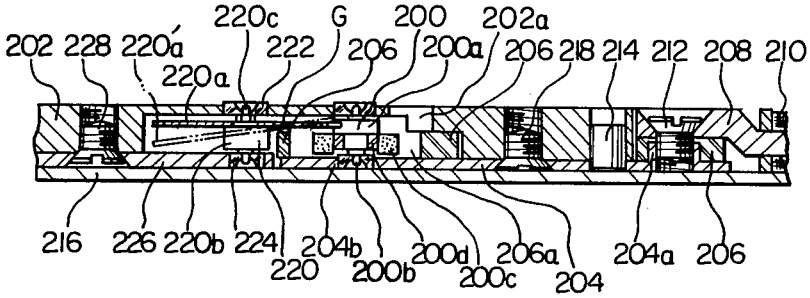
FIG. 9 is a cross sectional view of a modified form of the watch movement construction shown in FIGS. 1 to 7.

FIG. 9 shows a modification of a wristwatch movement construction according to the present invention. In FIG. 9, a rotor 200 interposed between a base plate 202 and a rotor supporting bridge 204 comprises a pinion **200*a*, a washer 200*d* coupled with the pinion 200*a* and a rotor magnet 200*c* bonded to the outer periphery of the washer 200*d* and having its surface coated with a thin plastic protecting layer. A stator 206 is spot welded to the rotor supporting bridge 204 and tightly connected at its end with an iron core 208 of a driving coil 210 by means of a flat head screw 212. The screw 212 is driven into an annular projection 204*a* of the rotor supporting bridge 204. The rotor 200 and stator 206 are essential parts of an electromechanical transducer of a quartz wrist watch. A bearing 204*b* is embedded in the rotor supporting bridge 204 while a pin 214 is provided to the base plate 202 to position the rotor supporting bridge 204 precisely in a predetermined plane. The rotor supporting bridge 204 integral with the stator 206** is fastened to a lower surface of the base plate 202 adjacent to a dial plate 216 by a screw 218. A hole 202*a* is formed in the base plate 202 for the observation of the action of the rotor 200. A sixth wheel and pinion 220 has a transmission wheel 220*a* meshing with teeth of the rotor pinion 200*a* and a rotary shaft 220*b* rigidly carrying the wheel 220*a* thereon. The wheel and pinion 220 is provided with a pivot shaft 220*c* rotatably received in a bearing 222 embedded in the base plate 202 whereas the other end of the wheel and pinion 220 is supported by a bearing 224 mounted to a wheel train bridge 226. The bridge 226 is fastened by a screw 228 to the lower surface of the base plate 202 in the same plane as the rotor supporting bridge 204.

During disassembly, the dial plate 216 is first removed and then the screw 218 is removed whereupon the integral assembly of the coil 210*a*, stator 206 and rotor supporting bridge 204 are removed. In this instance, the rotor 200 is also disassembled with its pivot shaft 200*b* held in the bearing 204*b* due to attraction between the rotor magnet 200*c* and the stator 206. It is to be noted that the weight of the rotor 200 should preferably be smaller than an attractive force between the rotor magnet 200*c* and the stator 206 so as to allow the pivot shaft 200*b* to remain in engagement with the bearing 204*b* due to said attractive force. Finally, the wheel train bridge 226 is removed from the base plate 202 and the sixth wheel and pinion 220 is taken out. The disassemblage of the bridge 226 and rotor supporting bridge 204 in the same direction not only makes the manipulation easy but facilitates ready shaving because of the flatness of the base plate 202. During assembly, the rotor supporting bridge 204 will be mounted together with the coil 210 and stator 206 while holding the rotor 200 in an air gap 206*a* of the stator 206 by the bearing 204*b*. Thus, the rotor 200 will not happen to be layed alone on a working table during disassembly and assembly stages and, hence, it is prevented from sticking to metal tools and attracting iron particles thereon. Also, cracks and breaks of the rotor magnet 200*c* are avoided inasmuch as it does not chance to engage with other component parts and tools. Since the rotor 200 is held between the base plate 202 and the rotor supporting bridge 204, the rotor 200 can show its action through the opening 202*a* of the base plate 202. The sixth wheel and pinion 220 is mounted in a manner indicated by a phantom line and a numeral 220'*a* in the drawing. If the wheel and pinion 220 is assembled before the rotor 200 is assembled, the rotor supporting bridge 204 might be mounted with the teeth of the pinion 200*a* kept disengaged from the transmission wheel 220*a* tending to damage the teeth of the wheel 220*a*. Accordingly, the gap G between the stator 206 and the base plate 202 spaced to be larger to permit the wheel 220*a* and the pivot 220*c* of the shaft 220*b* to smoothly enter the gap G under a condition in which the wheel 220*a* is inclined as shown by the phantom line.

The wheel train bridge 226 and rotor supporting bridge 204 may preferably have the same height to allow the shafts of the rotor 200 and sixth wheel and pinion 220 not to be affected by the influence of the dislocation of their axes and to support the dial plate 216 in the horizontal plane.

In an alternative arrangement, the transmission wheel may be rotatably mounted to the wheel train bridge 226 by rivets. While the two bearings are shown as embedded in the base plate 202 in FIG. 9, these bearings may be replaced with other members having the same function.

The modification of FIG. 9 is advantageous in that an electromechanical transducer is free from the loss of a rotor, adhesion of iron particles to the rotor and cracks and breaks of a rotor magnet which tend to occur during assembly and disassembly. This advantage make it possible to employ the rotor magnet made of a samarium-cobalt magnet which generates a large magnetomotive force but is fragile, increasing the output torque of the transducer. Additionally, the modification of FIG. 9 aids in the reduction of the thickness of a timepiece because the rotor magnet can be used in its naked condition.

Figure 10:
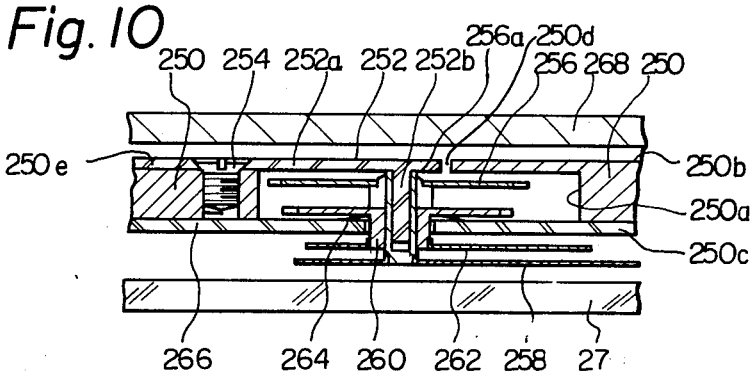
FIG. 10 is a cross sectional view of another modified form of the watch movement construction shown in FIGS. 1 to 7.

FIG. 10 shows another modification of the movement construction according to the present invention. In FIG. 10, the movement structure is shown as comprising a base plate 250 having at its lower surface 250*c* formed with a recessed portion 250*a* and a cutout 250*d*. The base plate 250 has an indented portion 250*e* formed at upper side of the base plate 10. A wheel train support member 252 has a flat portion 252*a* placed on and secured to the indented portion 250*e* of the base plate 250 by screw 254, such that the upper surface of the wheel train support member 252 is aligned with the upper surface 250*b* of the base plate 250. The flat portion of the wheel train support member 252 extends into the cutout 250*d* of the base plate 250 and has a central shaft 252*b* on which a shaft 256*a* of a center wheel 256 is rotatably mounted. The shaft 256*a* has its lower end carrying a minute hand 258. An hour wheel 260 is rotatably mounted on the shaft 256*a* and actuates an hour hand. A dial plate 266 is secured to the lower surface 250*c* of the base plate 250. Indicated at 264 is a washer disposed between the hour wheel 260 and the dial plate 266. Reference numeral 268 denotes a back cover and 270 a watch glass. The wheel train support member 252 may be made of iron and its flat portion 252*a* can have a reduced thickness yet providing a rigid structure. Hence, the length of the central shaft 252*b* may be increased for thereby preventing deflection of the hands 258 and 262. Another advantage of the structure shown in FIG. 10 is that the position of the central shaft 252*b* can be adjusted in an axial direction by inserting a thin spacer or spacers between the flat portion of the wheel train support member 252 and the base plate 250.

Figure 11:
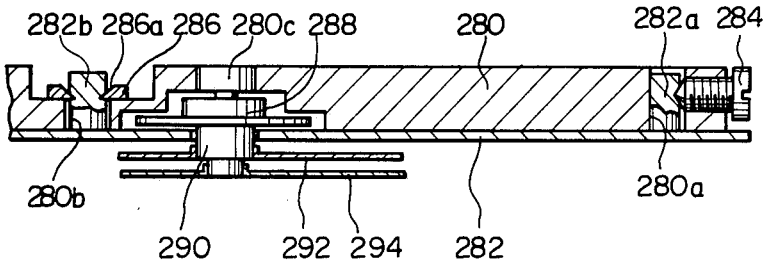
FIG. 11 is a cross sectional view of another modified form of the watch movement construction shown in FIGS. 1 to 7.
Figure 12:
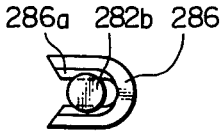
FIG. 12 is a plan view of a part of the construction shown in FIG. 11.
Figure 13:
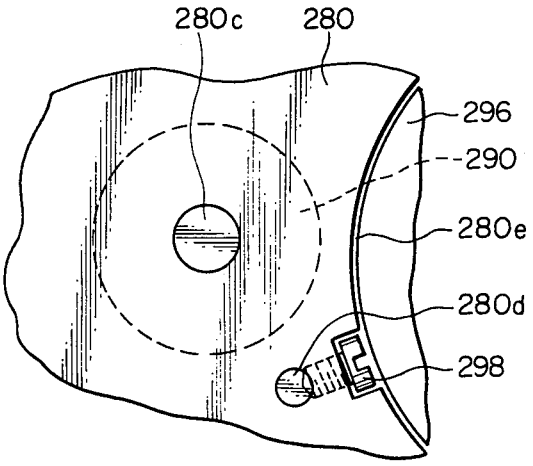
FIG. 13 is a fragmentary plan view of a modification of the construction of FIG. 11.

FIGS. 11 to 13 show another modification of the movement structure according to the present invention. FIG. 12 is a plan of a part of the structure shown in FIG. 11. In FIG. 11, base plate 280 having the same thickness as a movement is formed with a hole 280*a* in its outer peripheral portion in which a first leg or foot 282*a* brazed to a dial 282 is received. The dial 282 is secured to the base plate 280 by a screw 284. A second foot 282*b* also brazed to the dial 282 is disposed in a hole 280*b* formed in the base plate 280 at a position near a central area of the movement. A slant 286*a* of a wedge 286 bites the second leg 282*b* as illustrated in FIG. 11. The second foot 282*b* limits the vertical movement of the dial 282. Denoted at 280*c* is a centeral shaft studded in the base plate 280, 288 a cannon pinion coupled with the shaft 280*c*, 290 an hour wheel, 292 an hour hand, and 294 a minute hand.

In the movement construction of FIG. 11, the second foot 282*b* of the dial 282 is secured to the plate 280 at a position near an outer periphery of a flange 290*a* of the hour wheel 290. If, however, the second foot 282*b* of the dial 282 can not be secured to the base plate 280 at the position mentioned above due to some reasons, the second foot 282*b* may be secured to the base plate 280 at a central area thereof in a range having a diameter twice as large as the outside diameter of the flange 290*a* of the hour wheel 290. Thus, the dial 282 is engaged tightly with the base plate 280 to have the warp prevented. The cannon pinion 288 and hour wheel 290 are therefore kept stably in expected levels, establishing a preselected spacing between the hour hand 292 and the dial 282. In order to position the dial 282 in a horizontal plane precisely with respect to the base plate 10, to prevent axial displacement of the dial 282 and to remove the warp of the dial 282 it is preferable to have the dial provided with two feet in the outer peripheral portion of the dial and one foot in the central portion of the dial. However, any suitable number of legs may be employed if the warp of the dial 282 is little, e.g. one for each of peripheral and central portions.

A modification of the structure of FIG. 11 is illustrated in plan in FIG. 13, in which parts identical with or similar to those of the structure of FIGS. 11 and 12 are denoted by the same reference numerals. The hour wheel 290 is positioned at the back of the base plate 280 in a central area thereof. The base plate 280 is formed with a hole 280*d* at a position outwardly of the hour wheel 290 in order to receive a foot of the dial. Also provided to the base plate 280 is a wall 280*e* for guiding a power cell 296. A screw 298 is driven into the base plate 280 in perpendicular relation to the guide wall 280*e* so as to fixedly retain the leg of the dial. This arrangement will promote easier manipulation than the arrangement of FIG. 11 since the screw 298 can be operated merely after removing the power cell 296.

The arrangements of FIGS. 11 and 13 is advantageous in that, since the warp of a dial is prevented to stabilize the vertical positions of a cannon pinion and an hour wheel and the spacing between an hour hand and the dial, a wrist watch of an excellent quality is obtainable and the structure is applicable to a watch having a thin dial. Furthermore, it is possible to use a dial carrying an ornamental oxide film or the like on its surface, which involves substantial thermal shock and warp, and a dial formed of a soft material.

Figure 14:
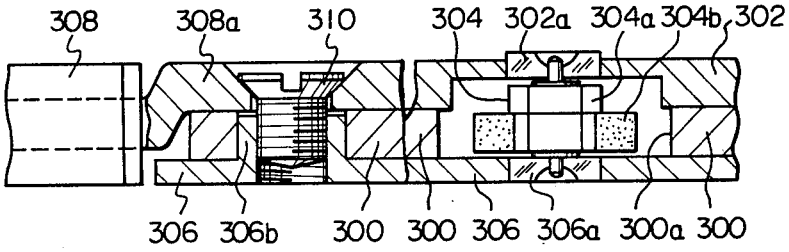
FIG. 14 is a fragmentary cross sectional view of another preferred embodiment of a watch movement construction according to the present invention.

FIG. 14 is a sectional view of another preferred embodiment of the movement structure according to the present invention. A stator 300 intimately engaged with a base plate 302 has an air gap 300*a* in which a rotor magnet 304*b* of a rotor assembly 304 is accommodated. The rotor magnet 304*b* is rigidly connected to a pinion 304*a* which is supported by a bearing 302*a* studded in the base plate 302 and a bearing 306*a* provided in a supporting plate 306 tightly engaged with the base plate 302. An iron core 308*a* extends through a driving coil 308 and has at opposite ends bents each of which is rigidly secured by a screw 310 to an upper surface of the stator 300. The screw 310 is driven into a projection 306*b* of the supporting plate 306. When driven, the screw 310 connects the stator 300 and the core 308*a* together for thereby facilitating ready handling operation. If magnetic saturation will take place due to the excitations of the coil 308 or the rotor magnet 304*b*, the efficiency of an electro-mechanical transducer is reduced. Therefore, cross-sectional areas of the core 308*a* and stator 300 forming a magnetic circuit must be as large as possible. Such cross-sectional areas are also desired in consideration of a fall of magnetic flux density of the material which might be caused by mechanical distortion during handling. Thus, the thickness of the above-mentioned components must be as large as possible. According to the arrangement shown in FIG. 14, the thickness of the movement exclusive of those components projecting beyond the movement exclusive of those components projecting beyond the movement with relatively small areas is predetermined to be substantially identical to the one of the coil 308. Also substantially identical to the thickness of the coil 308 is the total thickness of the core 308*a*, stator 300 and support plate 306. Hence, a magnetic circuit having a high saturation flux density can be established within the thickness of the movement. The head of the screw 310 is driven as shown beyond the upper end of a frustoconical opening of the core 308*a* of the coil 308.

Figure 15:
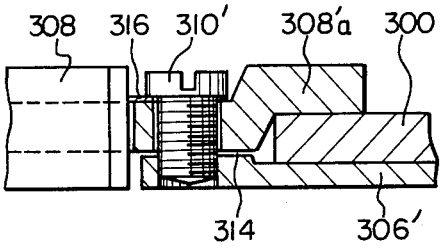
FIG. 15 is a fragmentary cross sectional view of a modification of the construction of FIG. 14.

A modified form of the structure of FIG. 14 is shown in FIG. 15 in which the rotor 304 and its associated parts are designed in the same way, as in FIG. 14 and therefore omitted. The bent of the core 308'*a* of the coil 308 is overlayed on the stator 300, and a screw 310' is driven into a supporting plate 306' at a position other than the bent of the core 308'*a* so as to tightly engage the stator 300 and the core 308'*a* to one another. Denoted 314 is a gap defined to promote complete engagement of the stator 300 and the core 308'*a*, and 316 a terminal plate soldered to the end of the coil 308.

Figure 16:
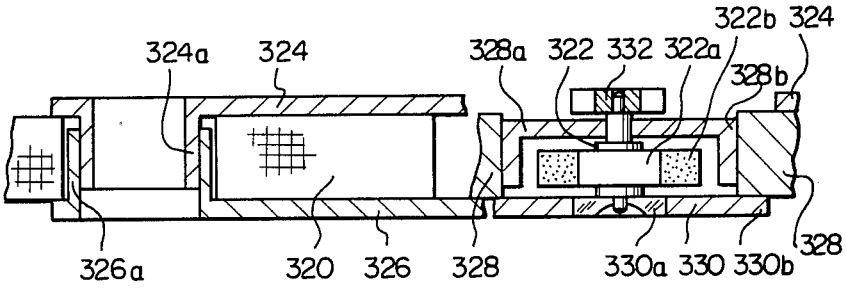
FIG. 16 is a fragmentary cross sectional view of a modification of the construction of FIG. 14.

Another modification of the structure of FIG. 14 is depicted in FIG. 16. A coil 320 is turned in parallel to the axis of a rotor assembly 322. Upper and lower iron cores 324 and 326 engages with each other at their projections 324*a* and 326*a*. These iron cores are welded to a stator 328 to form a single block. A seat 328*a* formed of polyacetal is disposed in and tightly fitted to a bore 328*b* of the stator 328 and cooperates with a bearing 330*a* of a base plate 330 to support shaft 322*a* of the rotor 322. Another function of the seat 328*a* is to avoid deposition of iron particles on the rotor magnet 322*b*. Numeral 332 designates a pinion connected to the shaft 322*a* to transmit rotation to a reduction wheel (not shown). The total thickness of the coil 320 and upper and lower cores 324 and 326 shown in FIG. 16 is substantially equal to the basic thickness of the movement structure which is also substantially equal to the total thickness of the stator 328, thin wall 330*b* of the base plate 330 and upper or lower cores 324 or 326.

If the stator 328 is supported at a position other than the engaging portion of the stator 328 and the core 324 or 326, the total thickness of the stator 328 and coil 320 can be made substantially identical to the basic thickness of the movement. It is to be noted that the arrangements of FIGS. 14, 15 and 16 may also be applicable to a movement structure having an additional mechanism layed below the arrangements discussed above, e.g. calendar mechanism. In such a case, the total thickness of the various components exclusive of the additional mechanism is made to be substantially equal to the basic thickness of the movement structure.

With the arrangement mentioned above, since a coil core and a stator each having a sufficient thickness can be accommodated in an area within the basic thickness of a movement structure, a magnetic circuit is afforded with a favorable efficiency.

Figure 17:
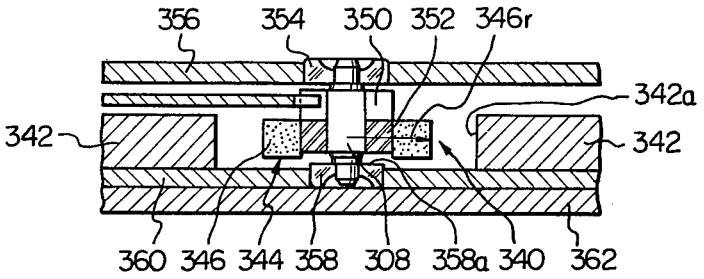
FIG. 17 is a fragmentary cross sectional view showing another preferred embodiment of a watch movement construction according to the present invention.

FIG. 17 is a cross section showing a part of another preferred embodiment of a movement structure according to the present invention. An electro-mechanical transducer 340 includes a stator 342, a rotor 344 disposed in an air gap 342*a* formed in the stator, a cylindrical rotor magnet 346 formed of an anisotropic rare earth material such as samarium-cobalt, a rotor shaft 348 having a pinion 350 and a bush member 352 formed of non-magnetic nylon or polyacetal resin and adapted to secure the rotor magnet 346 to the shaft 348. Connection between the shaft 348 and the non-magnetic bush member 352 and between the member 352 and the rotor magnet 346 may be accomplished either by press-fitting or by adhesive.

The shaft 348 is rotatably supported at one end by a bearing 354 fixed to a base plate 356 and at the other end by a bearing 358 retained by a bridge 360. The stator 342 is secured to the bridge 360 and a dial 362 is fixed to the underside of the bridge 360. The rotor magnet 346 has an outer diameter 346*r* which is smaller than that of the conventional rotor and the non-magnetic member 352 is formed of nylon or polyacetal resin in place of a metal while having its axial dimension reduced to a minimum. Thus, the inertia moment of the rotor 344 is markedly reduced within a range which does not affect the actions of the transducer 340. By so reducing the inertia moment of the rotor 344, there can be reduced the size of the bearing 358 supporting the rotor and therefore the thickness of the bridge 360 carrying the bearing 358 therewith. The stator 342 can therefore be layed on an upper flat surface of the bridge 360. Additionally, a lower end of the non-magnetic bush member 352 is disposed inwardly of the lower surface of the cylindrical rotor magnet 346 and the sectional area of a thrust bearing surface 358*a* of the bearing 358 is preselected to be smaller than the sectional area of the lower surface of the bush member 352. This permits the thrust bearing surface of the bearing 358 to project beyond the upper surface of the bridge 360 in confronting relation to the lower surface of the bush member 352, thereby minimizing the thickness of the assembly in the axial direction of the shaft 348. Rare earth magnets such as $Sm\text{-}Co_5$ are mechanically hard and fragile and therefore must be cut and perforated under strict management of dimensions. When the rare earth magnet is fixed to the rotor shaft, it is liable to be broken if a bush member made of metal is employed for securing the magnet. Accordingly, prior art bush member is composed of a large and strong fixing member. The embodiment of FIG. 17 has succeeded in the elimination of such a large size by forming the fixing member with a material which is softer and more efficient in the absorption of stress than metals, e.g. nylon or polyacetal resin.

Figure 18:
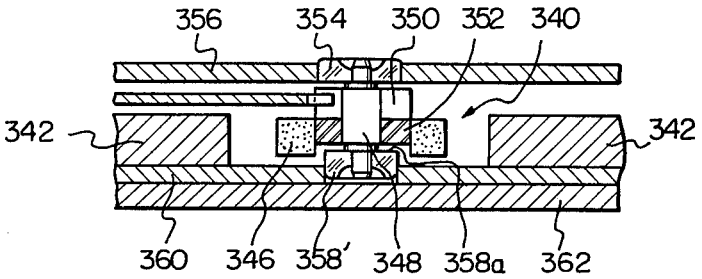
FIGS. 18 and 19 are fragmentary cross sectional views of modified forms of the construction shown in FIG. 17.

FIG. 18 shows a modification of the structure shown in FIG. 17, with like parts bearing the same reference numerals as those used in FIG. 17.

This alternative arrangement is contemplated to further enhance the resistivity of the rotor assembly with respect to eccentricity. To this end, a portion of a rotor shaft 348 extending from the lower end of a fixing member 352 to a bearing 358′ is shortened such that a thrust bearing surface 358′*a* of the bearing 358 engages with an end of the shaft 348 within a recess defined by a rotor magnet 346 and the bush member 352.

Figure 19:
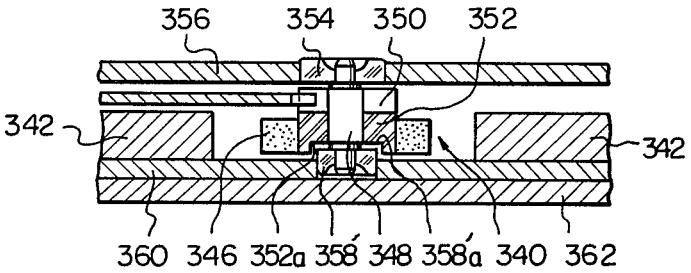

A farther modification of the structure of FIG. 18 is depicted in FIG. 19. In the arrangement shown in FIG. 19, a rotor magnet 346 is retained more firmly by a bush member 352 which is formed with an annular recess 352*a* to increase its contact area with the rotor magnet 346. Meanwhile, as in FIG. 18, a rotor shaft 348 is shortened and a thrust bearing surface 358′*a* of the bearing 358 lies in the annular recess 352*a* of the bush member 352.

With the arrangements of FIGS. 17 to 19, the inertia moment of a rotor assembly is minimized so that power consumption of the transducer is reduced and the strength of a bearing can be decreased in proportion to the decrease in the inertia moment. When such a bearing is disposed to confront a recess provided to a rotor in a concave-convex relation, the thickness of the rotor assembly in the axial direction of the rotor becomes far smaller than the conventional rotor assembly, affording a drastic solution to a problem which has been one of the largest stumbling blocks to the reduction of the overall thickness.

Figure 20:
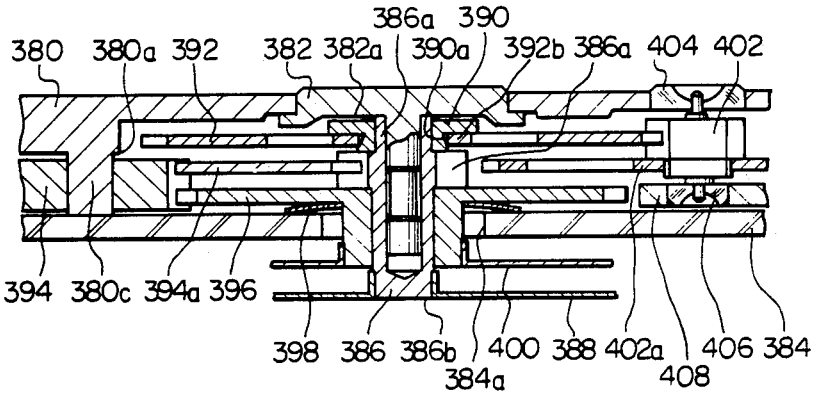
FIG. 20 is a fragmentary cross sectional view of another preferred embodiment of a watch movement construction according to the present invention.
Figure 21:
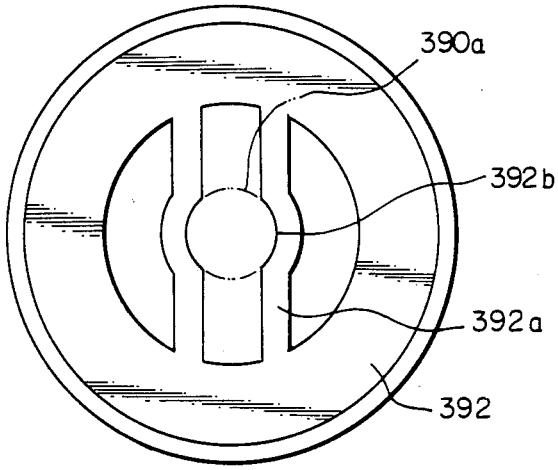
FIG. 21 is a plan view of a part of the watch movement construction of FIG. 20.

FIG. 20 shows a fragmentary cross sectional view of a modified form of the movement structure according to the present invention. In FIG. 20, the movement structure comprises a base plate 380 having its lower surface formed with a recessed portion 380*a* including a wall portion 380*b*, and a shaft portion 380*c*. A central shaft 382 is fixedly supported by the wall portion 380*b* of the base plate 380 and axially extends through a bore 384*a* of a dial 384. A center sleeve 386 is rotatably mounted on the central shaft 382 and actuates a minutes hand 388. The center sleeve 386 has an upper cylindrical section 386*a* to which a wheel retaining seat 390 is fixedly mounted. The wheel retaining seat 390 has an axially extending tapered cylindrical portion 390*a* by which a center wheel 392 is supported. As shown in FIG. 21, the center wheel 392 has a pair of radially extending, flexible retaining bridges 392*a* which have engagement portions 392*a*. The engagement portions 392*a* of the center wheel 392 engages with the tapered cylindrical portion 390*a* of the wheel retaining seat 390. The central shaft 382 has a downwardly facing annular recess 382*a* to which a part of the wheel retaining seat 390 extends, thereby permitting the reduction in thickness of the movement structure. Indicated at 386*a* is a pinion integral with the center sleeve 386. The pinion 386*a* is in mesh with a wheel 394*a* of a minutes wheel and pinion 394. The minutes wheel and pinion 394 has its pinion meshing with an hours wheel 396, which is biased upward by the action of a spring washer 398 disposed between the hour wheel 396 and the dial 384. An hours hand 400 is connected to and actuated by the hours wheel 396. Indicated at 402 is a reduction wheel and pinion having a wheel 402*a* driven by an electromechanical transducer (not shown) through another reduction wheels. The reduction wheel and pinion 402 is rotatably supported by bearings 404 and 406 provided to the base plate 380 and a wheel train bridge 408.

With the arrangement mentioned above, since the center wheel 392 has its engagement portions 392*b* engaged with the tapered cylindrical portion 390*a* of the wheel retaining seat 392 with a moderate pressure, the center wheel 392 is capable of slipping when an external force is applied to the center sleeve 386 from a time setting mechanism (not shown). Since, in addition, the engagement portions 392*b* are provided by the bridge portions 392*a* integral with a body of the center wheel 392, the total thickness of the center wheel 392 is made to a minimum value. Also, each of the bridge portions 392*a* has a narrow width and so the reaction force at the engagement portions 392*b* due to flexion of the bridge portions 392*a* is relatively small. In the arrangement of FIG. 20, the tapered cylindrical portion 390*a* has an outer diameter larger than the root diameter of the pinion 386*a* and, therefore, a stable slipping torque for the center wheel 392 can be obtained. The pinion 386*a* may be reduced in diameter and, in this case, a distance between the axis of the pinion 386*a* and the axis of the reduction wheel 402 can be reduced. In this manner, the distance between the axes between the other reduction wheels can also be reduced, thereby making it possible to provide a small size movement structure. If the minutes hand 388 and the end face 386*b* of the center sleeve 386 have surfaces different in color, the watch incorporating these components has an unattractive appearance. This defect can be avoided by surface treating the end face 386*b* of the center sleeve 386 in the same manner as the minutes hand 388. The surface treating may made by electro-plating or any other suitable expedients.

Figure 22:
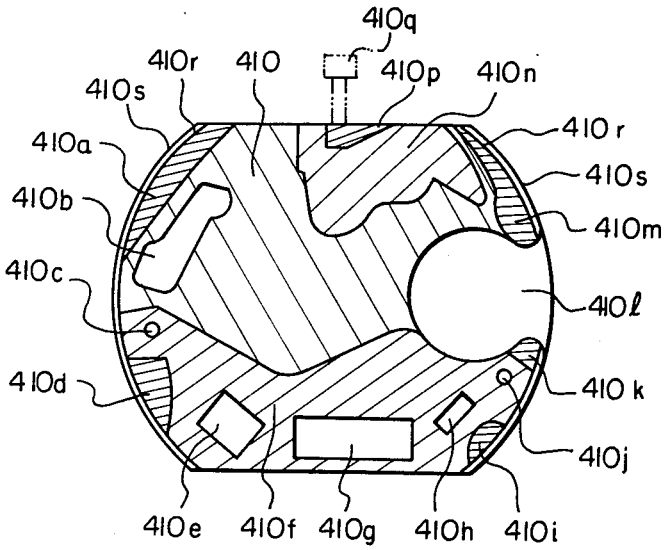
FIG. 22 is a plan view of another preferred embodiment of a watch movement construction according to the present invention.
Figure 23:
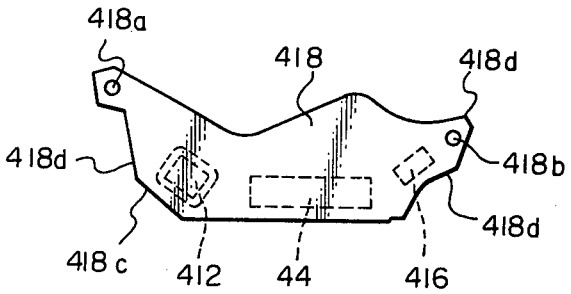
FIG. 23 is a plan view of a part of the watch movement construction of FIG. 22.

FIGS. 22 and 23 show another preferred embodiment of a movement structure according to the present invention. Numeral 410 denotes a base plate, and a wheel train (not shown) is disposed substantially in a central area thereof. The base plate 410 includes thick portions 410*a*, 410*d*, 410*i*, 410*k*, 410*m* and 410*p*, a cutout 410*b* for a stator (not shown), a screw hole 410*c* for fixing a circuit board, a cutout 410*e* for an IC block, a shaved or recessed portion 410*f* for the circuit board, a cutout 410*g* for a quartz crystal oscillator, a cutout 410*h* for a temperature compensating capacitor, a screw hole 410*j* for fixing the circuit board, a cutout 410*l* for accommodating a power cell, a shaved portion 410*n* for hand setting mechanism, barrel portions 410*r* and peripheral frange portions 410*s*. Denoted 410*q* is a winding crown. FIG. 23 is a plan view of a circuit board which carries on its back an IC block 412, a quartz crystal oscillator 414 and a capacitor 416 for temperature compensation. Denoted 418 in FIG. 23 is a circuit board, 418*a* and 418*b* are screw holes, and 418*c* is the periphery.

Figure 24:
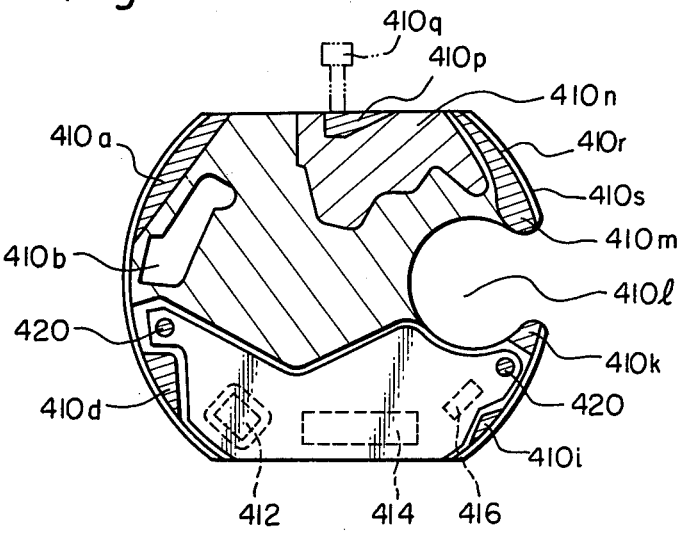
FIG. 24 is a plan view of the watch movement construction in which various electronic components are mounted.

FIG. 24 is a plan view showing the base plate 410 on which the circuit board 418 is layed. As shown, the IC block 412, quartz crystal oscillator 414 and capacitor 416 are received in the corresponding cutouts 410*e*, 410*g* and 410*h* of the base plate 410 and the circuit board 418 is fastened to the base plate 410 by screws 420.

Figure 25:
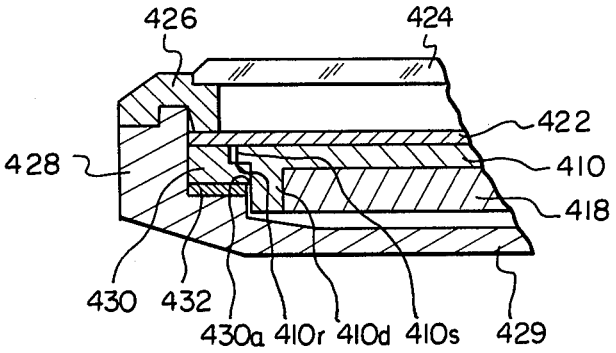
FIG. 25 is a fragmentary cross sectional view of a watch case incorporating the watch movement construction shown in FIG. 24.
Figure 26:
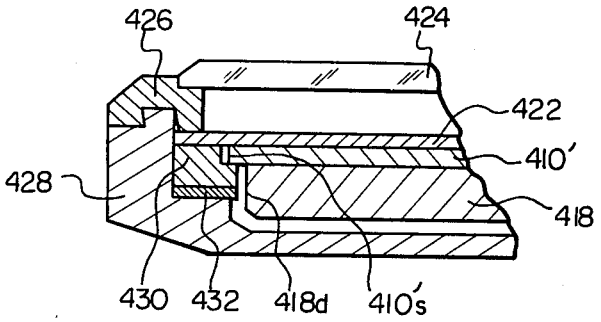
Fig. 26 PRIOR ART
FIG. 26 is a fragmentary cross sectional view of a watch case incorporating a conventional watch movement construction.

FIG. 25 is a fragmentary cross section of an assembly of a movement shown in FIG. 24 and a casing. The assembly comprises the base plate 410, the circuit board 418, the periphery of the flange 410*s*, the barrel portion 410*r*, a dial 422, a watchglass 424, an upper case band 426, a lower case band 428 formed integrally with a back cover 429, an intermediate frame 430 and a spring washer 432 for shock absorption. A conventional arrangement is shown in FIG. 26 in which a base plate 410' is void of the thick portion 410*d* provided to the base plate 410 of FIG. 25.

Since a prior art base plate 410' is not formed with the thick portions 410*d*, 410*i* and 410*k* which are present on the base plate 410 shown in FIG. 22, the periphery of the circuit board 418 when mounted on the base plate 410' will extend over almost one half of the entire periphery of the base plate 410'. FIG. 26 depicts in section a movement using such a prior art base plate 410' and installed in a casing of a timepiece. More specifically, the inner wall of the intermediate frame or that of the casing is engaged mainly by the periphery 418*d* of the circuit board 418. This is unfavorable because the precision of the contour and mechanical strength of the circuit board 418 are too poor to ensure accurate engagement. In contrast, according to the arrangement of FIG. 23, the circuit board 418 is formed with side walls 418*d* while the base plate 410 is formed with the thick portions 410*d*, 410*i* and 410*k* in positions corresponding to the side walls 418*d*. Thus, the upper end of each thick portion of the base plate 410 is substantially flush with each corresponding side wall of the circuit board 418. A movement employing the base plate 410 of the invention will assume the position depicted in FIG. 25 when placed in a casing and, therefore, it can be positioned accurately and easily in the diametrical direction. In other words, the outer walls 410*r* of the thick portions 410*d*, 410*i* and 410*k* of the base plate 410 will engage precisely with corresponding portions of the inner wall 430*a* of the intermediate frame 430. The same holds for a case wherein a coil quartz oscillator is mounted to a base plate.

The arrangement of FIGS. 22 to 25 is advantageous in that, since thick portions formed at suitable positions of the periphery of a base plate serve as guides, a movement can be positioned accurately and readily in a watch casing and its mechanical strength is increased. Also, screws for securing the movement and those for mounting a dial can be fixed with ease into predetermined positions.

Figure 27:
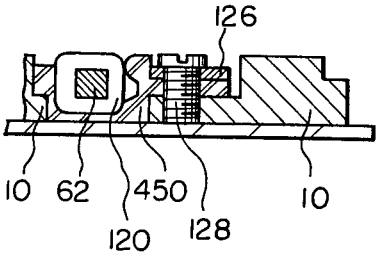
FIG. 27 is a fragmentary cross sectional view of a modification of the watch movement construction according to the present invention.

While the present invention has been shown and described with reference to particular embodiments and modifications, it should be noted that various other changes or modifications may be made without departing from the scope of the present invention. For example, although the coil retaining members 122 and 124 have been shown as separate members, the coil retaining member may comprises a single retaining member 450 which resiliently engages with side surfaces of the coil 120 as shown in FIG. 27.

Figure 28:
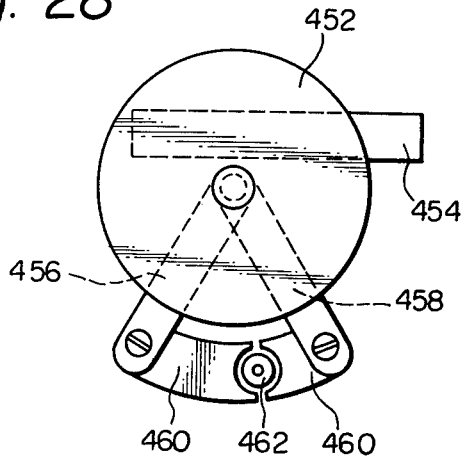
FIG. 28 is a plan view of another modification of the watch movement construction according to the present invention.

FIG. 28 illustrates a farther modification of the present invention contemplated to reinforce a flat driving coil 452. In a thin quartz crystal wrist watch, the driving coil needs a considerable number of turns in order to generate a magnetic flux in the stator. Such a need is particularly great in watches having movements of a thickness less than 2 mm. Applicable to extremely thin movements is a power cell whose thickness and therefore power capacity are far smaller than those of a power cell for driving conventional thick movements. Such a small power capacity can not drive a watch over one year or more unless the current consumption is suppressed. It follows that, to increase the conversion efficiency of an electro-mechanical transducer, use must be made of Sm-Co having a large magnetic force for the rotor while the number of turns of the coil must be increased to augment the magnetic flux density of the stator. Since, however, a large number of turns are unobtainable in a very thin movement when it comes to an elongate coil, a flat coil as represented by the coil 452 shown in FIG. 28 is usually installed. Though the flat coil can be provided with a significant number of turns, its strength is so limited by the large diameter and small thickness that even impacts of small magnitudes tend to deform and break the coil or cause short-circuiting therein by separating the insulative layer. Thus, reinforcement must be provided to the flat coil. For this purpose, a protective member of silicone rubber may be applied directly to the surfaces of the coil as seen in FIG. 27 or, alternatively, the coil may be held by a reinforcing plate 454 shown in FIG. 28 and prepared by coating the surfaces of a thin metal plate with plastics such as polyethylene as by baking, coating or immersing. Should the metal plate be held directly to the coil, the metal plate and the coil when subjected to an impact would rub each other to remove the insulating layer from the wire resulting in short-circuiting of the coil. Additionally, yokes 456 and 458 connected to stators 460 and 462 may be provided with a plastic coating for reinforcement or a sheet of vinyl or polyethylene may be layed between the yokes 456 and 458 and the coil 452.

Indicated at 462 is a rotor. The arrangement of FIG. 28 is advantageous in that, since at least one elastic member for protection is used to hold the outer periphery of a coil, shocks and impacts which would be applied to the coil upon fall of a watch or during manual work can be satisfactorily absorbed and, hence, the coil and its core can be protected against deformation and damage such as bending of the core and breakage of the coil.

What is claimed is:

1. A movement construction for an electronic timepiece powered by a battery and having an electronic circuit section arranged to provide drive signals indicative of time information, and an electro-mechanical transducer responsive to said drive signals to actuate time-indicating hands adjacent a time dial to display said time information, comprising:

a base plate having its one side fixedly supporting said time dial and having a thickness substantially equal to a thickness of said movement construction, said base plate including a central region and first and second marginal regions;

a wheel train mechanism disposed in said central region of said base plate substantially within the thickness of said base plate, said wheel train mechanism being driven by said electro-mechanical transducer for actuating said time-indicating hands;

said electro-mechanical transducer being disposed in said first marginal region of said base plate substantially within the thickness of said base plate; and said electronic circuit section including a circuit substrate and a plurality of electronic components disposed in said second marginal region of said base plate substantially within the thickness of said base plate.

2. A movement construction according to claim 1, in which said central region of said base plate includes a recessed portion having a thin wall portion, and said first and second marginal regions have recessed portions indented from another surface of said base plate to accommodate said electro-mechanical transducer and electronic circuit section, respectively, and further comprising a wheel train bridge axially spaced from said thin wall portion and secured to said one surface of said base plate at said central region thereof such that one surface of said wheel train bridge is substantially aligned with the one surface of said base plate, said wheel train mechanism being disposed in said recessed portion and rotatably supported by said thin wall portion and said wheel train bridge.

3. A movement construction according to claim 2, further comprising a central shaft axially extending from said thin wall portion of said recessed portion, and in which said wheel train mechanism comprises a center wheel rotatably supported by said central shaft.

4. A movement construction according to claim 3, in which said central shaft has its upper end substantially aligned in the same plane as another surface of said base plate.

5. A movement construction according to claim 2, further comprising a rotor supporting bridge axially spaced from said thin wall portion and secured to the one side of said base plate such that one surface of said rotor supporting bridge is substantially aligned with said one side of said base plate.

6. A movement construction according to claim 5, in which said electro-mechanical transducer includes a rotor operatively disposed in said recessed portion and rotatably supported by said thin wall portion and said rotor supporting bridge.

7. A movement construction according to claim 6, in which said rotor has its axial length substantially equal to the thickness of said base plate.

8. A movement construction according to claim 5 or 6, in which said rotor comprises a pinion and a shaft integral with pinion and having its axial length substantially equal to the thickness of said base plate.

9. A movement construction according to claim 8, in which said wheel train mechanism comprises reduction wheels having their shafts substantially equal in length to the thickness of said base plate.

10. A movement construction according to claim 9, in which one of said reduction wheels is in mesh with said pinion of said rotor within said recessed portion of said central region.

11. A movement construction according to claim 8, in which said electro-mechanical transducer also includes a stator disposed in said recessed portion of said first marginal region and attached to said rotor supporting bridge.

12. A movement construction according to claim 11, in which said stator of said electro-mechanical transducer is spaced from said thin wall portion of said recessed portion by a predetermined gap to allow said reduction wheel and pinion to enter said gap during assembly of said movement construction.

13. A movement construction according to claim 3, in which said wheel train mechanism comprises a third wheel and pinion with which a gear wheel of said center wheel meshes, and a minutes wheel meshing with a pinion of said center wheel, said third wheel and pinion including a gear wheel aligned substantially in the plane as said minutes wheel.

14. A movement construction according to claim 3, in which said thin wall portion is formed with a cutout and in which said central shaft is integral with a wheel train supporting member secured to another side of said base plate such that one surface of said wheel train supporting member is substantially aligned with said another side of said base plate.

15. A movement construction according to claim 8, in which said rotor also comprises a non-magnetic bush member fixedly mounted on said shaft, and a rotor magnet fixedly supported by said non-magnetic bush member.

16. A movement construction according to claim 15, in which said rotor has an annular recess formed at a lower end of said rotor.

17. A movement construction according to claim 16, in which said rotor supporting bridge has a bearing for rotatably supporting a lower end of said shaft of said rotor.

18. A movement construction according to claim 17, in which said bearing has its upper surface projecting toward said annular recess of said rotor.

19. A movement construction according to claim 17, in which said bearing has its upper portion partially disposed in the annular recess of said rotor.

20. A movement construction according to claim 16, in which said non-magnetic bush member is smaller in thickness than said rotor magnet to thereby provide said annular recess.

21. A movement construction according to claim 16, in which said non-magnetic bush member has its lower end formed with said annular recess.

22. A movement construction according to claim 15, in which said non-magnetic bush member is made of polyacetal resin.

23. A movement construction according to claim 15, in which said non-magnetic bush member is made of a nylon resin.

24. A movement construction according to claim 15, in which the shaft of said rotor has a length less than 2 mm.

25. A movement construction according to claim 5, in which said first marginal region of said base plate has a cutout, and in which said electromechanical transducer comprises a driving coil disposed in the cutout of said first marginal region of said base plate.

26. A movement construction according to claim 25, in which said driving coil has an axial thickness substantially equal to the thickness of said base plate.

27. A movement construction according to claim 25 or 26, in which said electro-mechanical transducer also comprises a core extending through said driving coil and connected to said stator.

28. A movement construction according to claim 27, in which the total thickness of said core, said stator and said rotor supporting bridge is substantially equal to the thickness of said base plate.

29. A movement construction according to claim 25 or 26, further comprising coil retaining means disposed in the cutout of said first marginal region of said base plate to resiliently retain said driving coil.

30. A movement construction according to claim 29, in which said coil retaining means comprises first and second coil retaining members engaging side surfaces of said driving coil, respectively.

31. A movement construction according to claim 30, in which said first coil retaining member is made of polyacetal resin.

32. A movement construction according to claim 30, in which said second coil retaining member is made of a silicone rubber.

33. A movement construction according to claim 29, in which said coil retaining means comprises a single coil retaining member.

34. A movement construction according to claim 33, in which said single coil retaining member is made of a rubber.

35. A movement construction according to claim 3, in which said base plate has an axially extending through-hole formed in said central region of said base plate, and in which said time dial has an axially extending leg which is disposed in said axially extending through-hole, and means for fixedly retaining said leg of said time dial in said axially extending through-hole.

36. A movement construction according to claim 35, in which said axially extending hole is formed at a position near said center wheel.

37. A movement construction according to claim 1 or 2, in which said electronic timepiece has a casing for supporting said movement structure, and in which said base plate has a plurality of thick portions provided at an outer peripheral portion of said base plate to engage with said casing.

38. A movement construction according to claim 1, in which said circuit substrate is made of a German silver.

39. A movement construction according to claim 1 or 38, in which said circuit substrate has its one surface provided with a flexible sheet having a conductive pattern.

40. A movement construction according to claim 39, in which said circuit substrate has at least one bent portion to support at least one of said plurality of electronic components.

41. A movement construction according to claim 39, in which said flexible sheet is placed on another side of said base plate in such a manner that said conductive pattern faces said another surface of said base plate.

42. A movement construction according to claim 38, in which said circuit substrate has a stepped portion to support one of said plurality of electronic components.

43. A movement construction according to claim 3, in which said center wheel has a wheel retaining seat having a tapered portion, and in which said center wheel has resilient engaging portions engaging with said tapered portion of said wheel retaining seat.

44. A movement construction according to claim 1, in which said base plate also has a third marginal region, and further comprising a hand setting mechanism disposed in the third marginal region of said base plate.

45. A movement construction according to claim 44, in which said base plate has a radially extending bore formed at said third marginal region, and in which said hand setting mechanism includes a time setting stem having a shaft portion slidably received in said radially extending bore of said base plate.

46. A movement construction according to claim 45, in which said time setting stem also has a reduced diameter portion extending from said shaft portion, and a large diameter portion integral with a toothed portion, with the large diameter portion being identical in diameter to said toothed portion.

47. A movement construction according to claim 46, in which said hand setting mechanism also includes a setting wheel, with which said toothed portion of said time setting stem is held in meshing engagement at all times.

48. A movement construction according to claim 46, in which said hand setting mechanism also includes a setting lever engaging with the reduced diameter portion of said time setting stem and disposed in an indented portion of said base plate formed in the third marginal region thereof, and a setting lever spring disposed on another side of said base plate.

49. A movement construction according to claim 48, in which said setting lever spring is liftable along an axis of said base plate during insertion and removal of said time setting stem into and out of said radially extending bore of said base plate.

50. A movement construction according to claim 49, in which said electronic timepiece has a back cover and said setting lever spring is spaced from said back cover by a predetermined distance to allow a prescribed amount of lift of said setting lever spring.

51. A movement construction according to claim 9, in which said electro-mechanical transducer also includes a stator disposed in said recessed portion of said first marginal region and attached to said rotor supporting bridge.

52. A movement construction according to claim 10, in which said electro-mechanical transducer also includes a stator disposed in said recessed portion of said first marginal region and attached to said rotor supporting bridge.

53. A movement construction according to claim 51, in which said stator of said electro-mechanical transducer is spaced from said thin wall portion of said recessed portion by a predetermined gap to allow said reduction wheel and pinion to enter said gap during assembly of said movement construction.

54. A movement construction according to claim 52, in which said stator of said electro-mechanical transducer is spaced from said thin wall portion of said recessed portion by a predetermined gap to allow said reduction wheel and pinion to enter said gap during assembly of said movement construction.

55. A movement construction according to claim 4, in which said wheel train mechanism comprises a third wheel and pinion with which a gear wheel of said center wheel meshes, and a minutes wheel meshing with a pinion of said center wheel, said third wheel and pinion including a gear wheel aligned substantially in the plane as said minutes wheel.

56. A movement construction according to claim 4, in which said thin wall portion is formed with a cutout and in which said central shaft is integral with a wheel train supporting member secured to another side of said base plate such that one surface of said wheel train supporting member is substantially aligned with said another side of said base plate.

57. A movement construction according to claim 16, in which said non-magnetic bush member is made of polyacetal resin.

58. A movement construction according to claim 17, in which said non-magnetic bush member is made of polyacetal resin.

59. A movement construction according to claim 18, in which said non-magnetic bush member is made of polyacetal resin.

60. A movement construction according to claim 19, in which said non-magnetic bush member is made of polyacetal resin.

61. A movement construction according to claim 20, in which said non-magnetic bush member is made of polyacetal resin.

62. A movement construction according to claim 21, in which said non-magnetic bush member is made of polyacetal resin.

63. A movement construction according to claim 16, in which said non-magenetic bush member is made of a nylon resin.

64. A movement construction according to claim 17, in which said non-magnetic bush member is made of a nylon resin.

65. A movement construction according to claim 18, in which said non-magnetic bush member is made of a nylon resin.

66. A movement construction according to claim 19, in which said non-magnetic bush member is made of a nylon resin.

67. A movement construction according to claim 20, in which said non-magnetic bush member is made of a nylon resin.

68. A movement construction according to claim 21, in which said non-magnetic bush member is made of a nylon resin.

69. A movement construction according to claim 31, in which said second coil retaining member is made of a silicone rubber.

70. A movement construction for an electronic timepiece driven by a stepping motor powered by a battery and including a time dial having a central bore formed therein, comprising:

a base plate having a cutout formed in close proximity to one portion of an outer periphery of said base plate to accommodate therein said battery, and a recess formed in close proximity to another portion of the outer periphery of said base plate;

a wheel train bridge and a stator retaining plate mounted on one side of said base plate in the same plane;

a wheel train mechanism disposed in a space between said base plate and said wheel train bridge in a central region of said base plate, said wheel train mechanism including a central shaft implanted in said base plate at a central region thereof, a center wheel and pinion and an hour wheel rotatably supported by said central shaft, said central shaft extending through the central bore of said time dial; and a cylindrical, elongated driving coil forming part of said stepping motor and disposed in said recess of said base plate;

said base plate having a thickness substantially equal to a thickness of said movement construction.

71. A movement construction according to claim 70, in which said stepping motor comprises a rotor stem rotatably supported by said base plate and said stator retaining plate, said rotor stem having its axial length substantially equal to the diameter of said driving coil and the thickness of said movement construction.

72. A movement construction according to claim 71, in which the axial length of said rotor stem is less than 2 mm.

73. A movement construction for an electronic timepiece driven by a stepping motor powered by a battery and including a time dial having a central bore formed therein, comprising:

a base plate having a cutout formed in close proximity to one portion of an outer periphery of said base plate to accommodate therein said battery, and a recess formed in close proximity to another portion of the outer periphery of said base plate, said base plate having a thickness substantially equal to a thickness of said movement construction;

a wheel train bridge and a stator retaining plate mounted on one side of said base plate in the same plane;

a wheel train mechanism disposed in a space between said base plate and said wheel train bridge in a central region of said base plate within the thickness of said base plate, said wheel train mechanism including a central shaft implanted in said base plate at a central region thereof, a center wheel and pinion and an hour wheel rotatably supported by said central shaft, said central shaft extending through the central bore of said time dial; and a cylindrical, elongated driving coil forming part of said stepping motor and disposed in said recess of said base plate within the thickness of said base plate.

74. A movement construction for an electronic timepiece powered by a battery and having an electronic circuit section arranged to provide drive signals indicative of time information, and an electro-mechanical transducer responsive to said drive signals to actuate time-indicating hands adjacent a time dial to display said time information, comprising:

a base plate having its one side fixedly supporting said time dial and having a thickness substantially equal to a thickness of said movement construction, said base plate including a central region and first and second marginal regions;

a wheel train mechanism disposed in said central region of said base plate substantially in the same plane as said base plate within the thickness of said base plate, said wheel train mechanism being driven by said electro-mechanical transducer for actuating said time-indicating hands;

said electro-mechanical transducer being disposed in said first marginal region of said base plate substantially in the same plane as said wheel train mechanism within the thickness of said base plate; and said electronic circuit section including a circuit substrate and a plurality of electronic components disposed in said second marginal region of said base plate substantially in the same plane as said wheel train mechanism and said electro-mechanical transducer within the thickness of said base plate.

* * * * *